US007631673B2

(12) United States Patent
Salovaara

(10) Patent No.: US 7,631,673 B2
(45) Date of Patent: Dec. 15, 2009

(54) VENEER CUTTER

(75) Inventor: Reijo Salovaara, Nastola (FI)

(73) Assignee: Raute Oyj, Nastola (FI)

( * ) Notice: Subject to any disclaimer, the term of this patent is extended or adjusted under 35 U.S.C. 154(b) by 412 days.

(21) Appl. No.: 11/704,949

(22) Filed: Feb. 12, 2007

(65) Prior Publication Data

US 2007/0199621 A1 Aug. 30, 2007

(30) Foreign Application Priority Data

Feb. 15, 2006 (FI) ..... 20060141

(51) Int. Cl.
*B27C 1/00* (2006.01)

(52) U.S. Cl. ..... 144/162.1; 144/178; 83/622; 83/694

(58) Field of Classification Search ..... 144/162.1, 144/166, 178; 83/622, 694
See application file for complete search history.

(56) References Cited

U.S. PATENT DOCUMENTS 3,477,327 A * 11/1969 Aizawa ..... 83/371
3,540,340 A * 11/1970 Koskela ..... 83/499
4,181,055 A 1/1980 Miyata
4,658,684 A 4/1987 Brookhyser
2005/0217453 A1* 10/2005 Matthes et al. ..... 83/694

FOREIGN PATENT DOCUMENTS

EP 0 500 181 8/1992

* cited by examiner

*Primary Examiner*—Shelley Self
(74) *Attorney, Agent, or Firm*—Young & Thompson

(57) ABSTRACT

Veneer cutter, wherein the cutting is provided by a blade, the front rake face thereof being movable to pass a stationary counter blade, substantially in a perpendicular direction to the plane of the veneer. The cutter includes two blades in a common cutting movement and arranged at a distance from each other in the feed direction of the veneer. The cutting blades are located with their front rake faces facing away from each other, and the first blade in the feed direction is positioned at a higher elevation from a common plane of the counter blades than the second blade.

4 Claims, 6 Drawing Sheets

VENEER CUTTER

BACKGROUND OF THE INVENTION

The present invention concerns a veneer cutter, primarily a guillotine-type cutter applicable for cutting plywood face veneer.

DESCRIPTION OF THE RELATED ART

The face veneer forming the top and bottom layers of plywood must be cut very precisely, as well for the part of cutting the front edge, rear edge as the defective portions thereof. A good cutting result can be provided with a guillotine-type cutter, wherein the cutting blade has a one-sided beveled edge, and the cutting is performed with the blade having its front rake face passing closely the shear edge of a counter blade. One problem with the cutters of prior art has been, that the cutters are able to apply this cutting, providing the best final result, alternatively to perform a front edge cutting or a rear edge cutting only for a veneer sheet progressing through the cutter.

SUMMARY OF THE INVENTION

An improvement of the above described problem has been achieved by means of a plywood veneer cutter according to the present invention, wherein the cutting is performed by means of a blade having a one-sided beveled cutting edge and consequently an essentially planar front rake, by passing the front rake face of the blade closely a shear edge of a stationary counter blade, substantially in the perpendicular direction to the plane of the veneer, whereby there are two of said blades in a common reciprocating cutting movement at a distance from each other in the feeding direction of the veneer. The cutting blades are arranged with their front rake faces facing away from each other and the first blade is positioned to reach a higher elevation during the cutting stroke from the veneer to be cut than the second blade.

BRIEF DESCRIPTION OF THE FIGURES

The construction and way of operation of the cutter according to the invention will be described in the following, with respect to the enclosed drawing, wherein.

DESCRIPTION OF THE PREFERRED EMBODIMENTS

Figure 1:
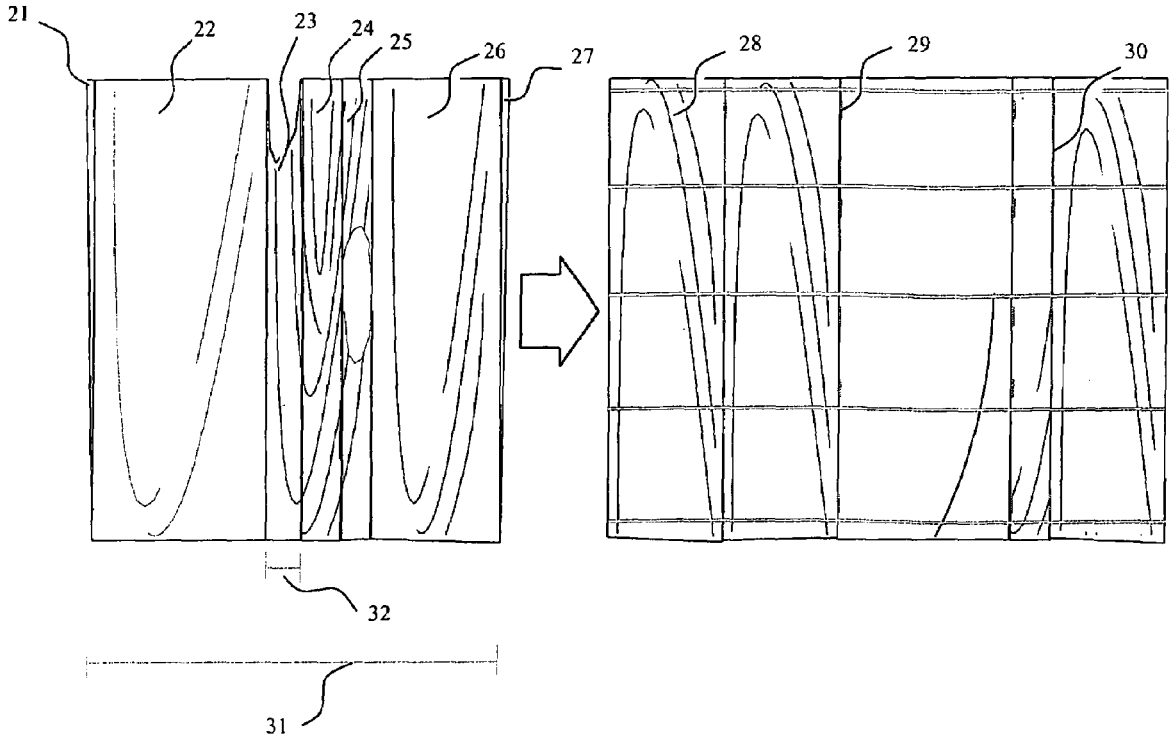
FIG. 1 is a principle diagram of trimming of a defective veneer sheet.

In the situation of FIG. 1, a cutting diagram is illustrated for a veneer sheet having different types of quality defects. Defective portions are removed, and the good veneer portions are combined in a veneer jointing machine into a veneer sheet acceptable as a face veneer for plywood. Firstly, the front edge or the leading edge of the veneer must be absolutely straight and perpendicular to the side edge lines of the veneer. This is not always the case. This straightening cutting is illustrated in FIG. 1 as cutting off the slice 27.

After this cutting, the veneer can have a good portion 26 of a random width, ending up to a defective portion 25 (in this text the term "width" means traditionally the direction crossing the grain direction of the veneer). In this portion a device controlling the veneer entering the cutter has noticed a hole in the central area of the veneer. The defective portion is removed and guided to a scrap veneer disposing means. The following good portion 24, again, is recovered, etc.

The good veneer portions 28 of different widths received from the cutting are combined into a face veneer sheet in a jointing machine, wherein the veneer pieces are bonded with an abutment joint using a suitable gluing technique, like glue spots or glue string to form a face veneer sheet. The basic construction of one embodiment of the cutter used for the above described cutting procedure is illustrated in the enclosed FIG. 2. The cutter is shown in the figure at the initial position of the cutting procedure.

The figure shows a stationary frame beam 1 of the cutter, supporting a movable blade beam 14. The blade beam 14 is connected to the frame beam 1 by means of an actuator 9 for providing the cutting operation of the cutter. The actuator is in the described embodiment a cylinder-piston apparatus 9, being able to move the blade beam back and forth in the vertical direction for the stroke length required by the cutting movement.

Cutting blades 3 and 3' are mounted onto the opposite vertical sides of the blade beam 14, the blades being immovable with respect to the blade beam. Thus, the cutting blades are located in the feed direction A of the veneer at the distance from each other defined by the width of the blade beam 14. The first and second cutting blades 3 and 3', respectively, are at their lower edge beveled one-sided, whereby the front rake face is down to the cutting edge substantially straight. The cutting blades are attached to the blade beam so that their front rake faces are facing away from each other, and their sharpening bevels are facing to each other.

Both of the cutting blades 3 and 3' have a counter blade 11, 11', respectively, located in the apparatus so, that their shear edges are facing to each other. In other words, the front rake faces of the cutting blades 3 and 3' facing away from each other are designed to move closely with respect to the shear edge of their respective counter blade during the cutting movement, at a distance of a cutting tolerance.

With the above described blade arrangement, the cutter can be provided with a function, wherein the edge remaining to the usable portion of the veneer to be cut respectively can be arranged to be an edge which during the cutting was facing against the front rake face of the cutting blade, and supported during the cutting on the shear edge of the counter blade.

Due to the free space B left between the counter blades 11 and 11', the scrap portions resulted from the cutting can be removed from the cutter.

The operations model of the cutter in accordance with the invention is described with reference to the enclosed FIGS. 3 to 6.

Figure 3:
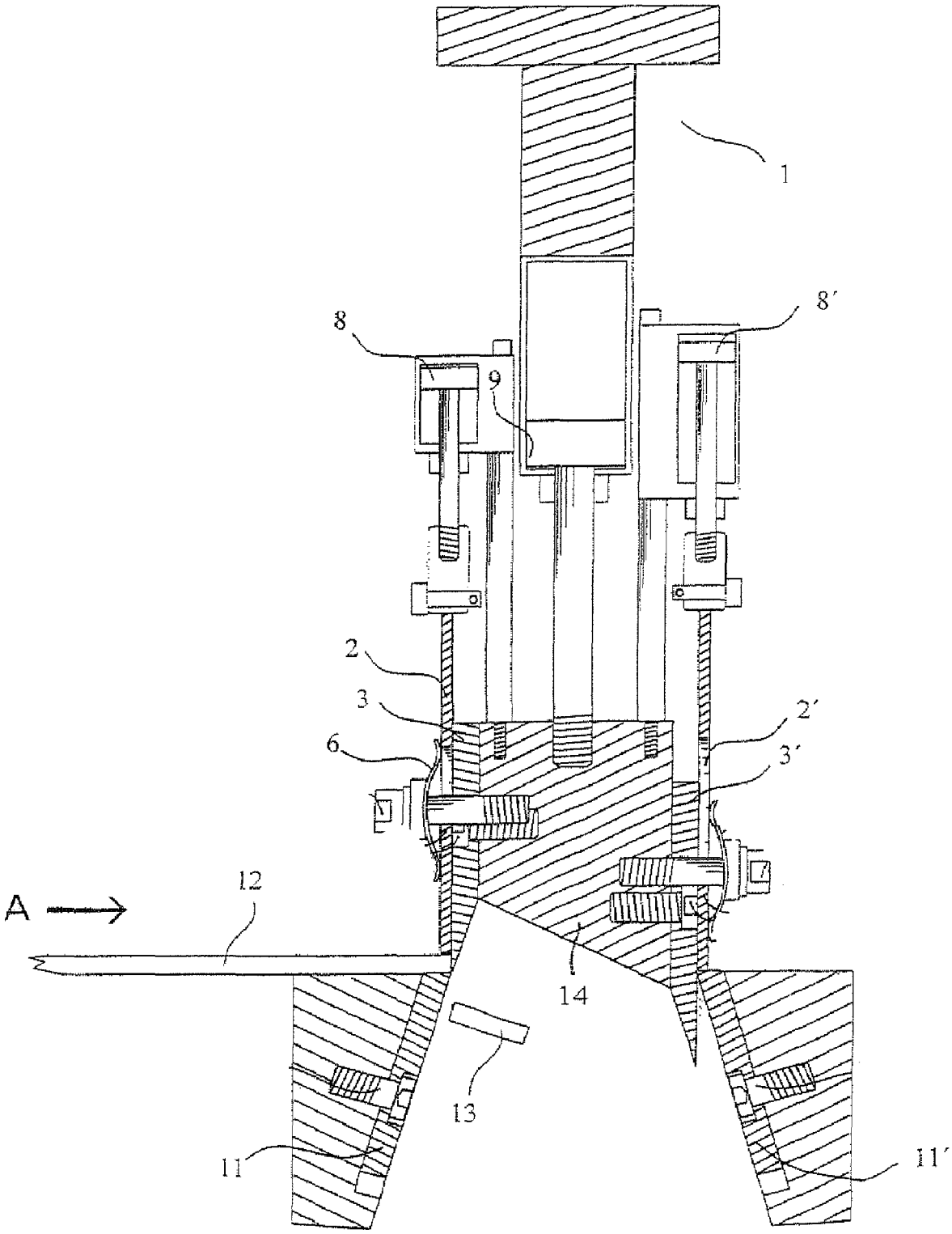
FIG. 3 illustrates the veneer cutter of FIG. 2, when cutting the front edge of a veneer sheet.
Figure 4:
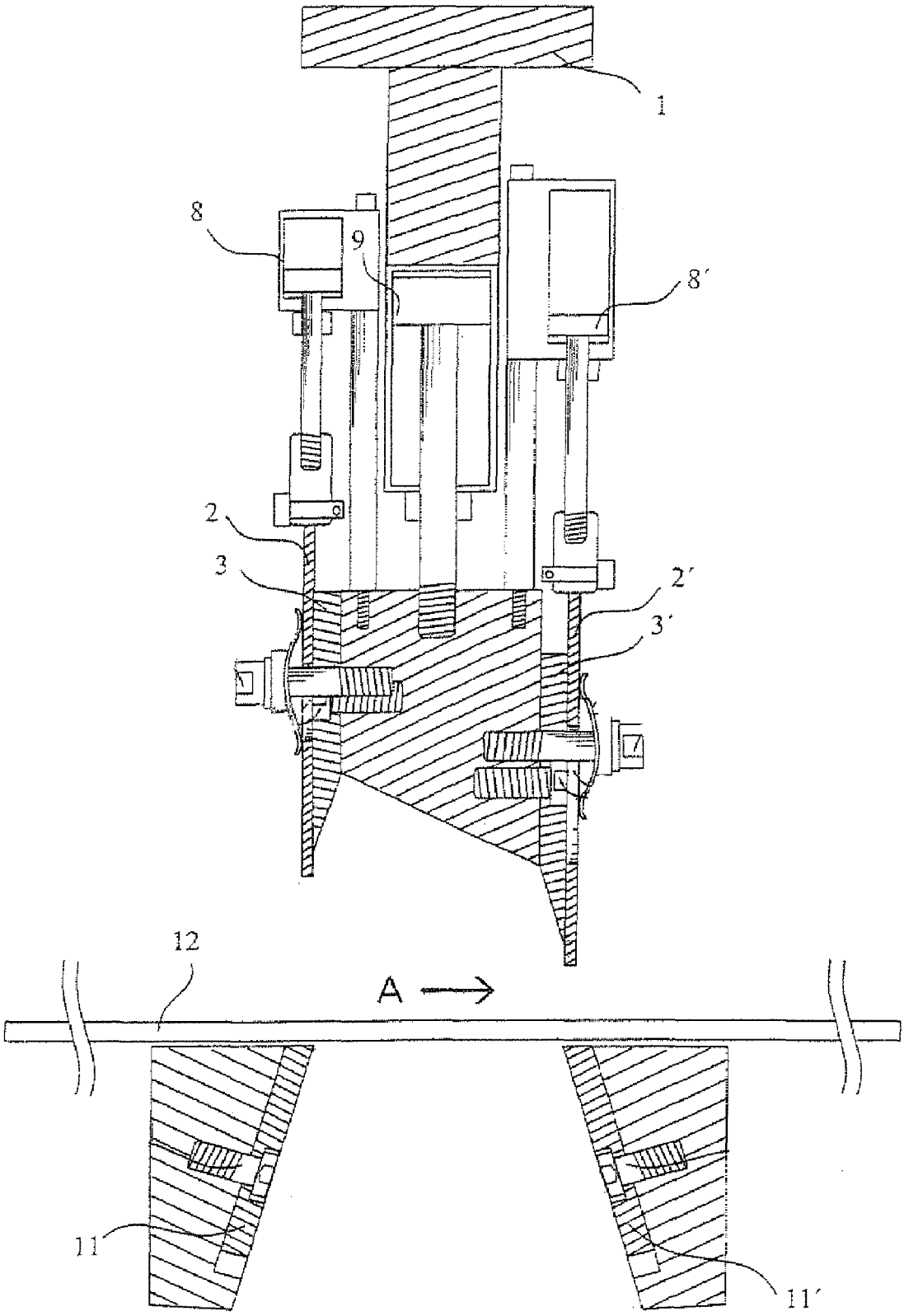
FIG. 4 illustrates a veneer cutter of FIG. 2 in an operational situation, where a good veneer sheet is transported through the cutter.
Figure 5:
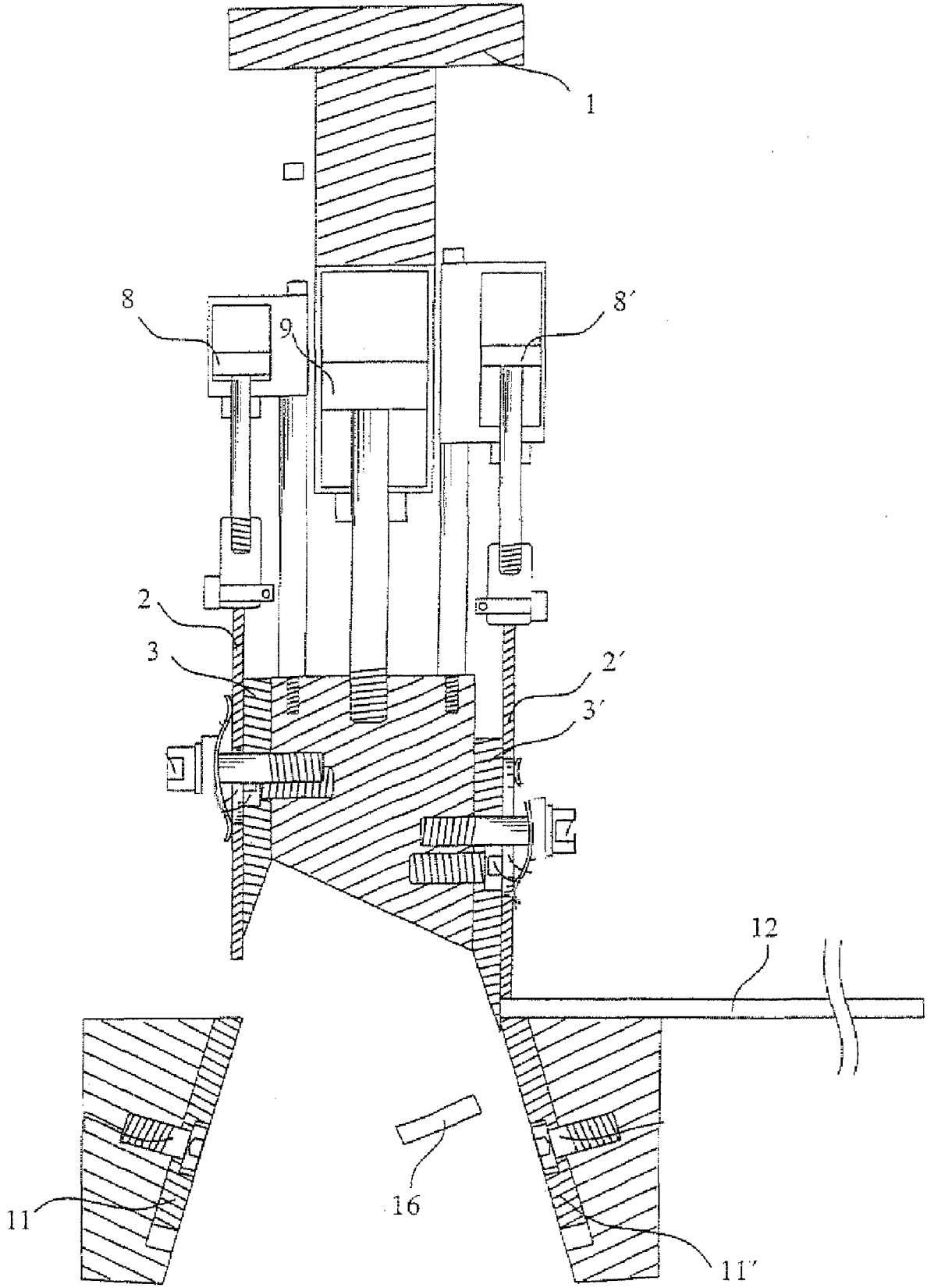
FIG. 5 illustrates the veneer cutter of FIG. 2, when cutting the rear edge of a veneer sheet.

In FIG. 3, a veneer sheet 12 has been fed in the direction A guided by a preceding feed and control apparatus onto the counter blade 11 of the first cutting blade 3 for a length that has been defined by a control apparatus as a cutaway portion (slice 27 in FIG. 1). The blade beam 14 is ordered to perform a cutting stroke, whereby the blade 3 cuts the slice 13 from the front edge of the veneer. If the control apparatus had found the remaining veneer sheet to be good, the feeding apparatus takes the veneer sheet 12 through the cutter (FIG. 4) into a phase shown in FIG. 5. In this phase the rear edge of the veneer sheet is straightened by removing a slice 16 therefrom.

In case the control apparatus has discovered defective portions (portions 23; 25) in FIG. 1), in the veneer, the operation of the cutter is controlled corresponding to the operation described above, in other words, the cutting before a defective portion is performed with the second blade 3' and the cutting after the defective portion is performed with the first blade 3. The defective cutaway portion drops down between the counter blades 11 and 11'.

Figure 6:
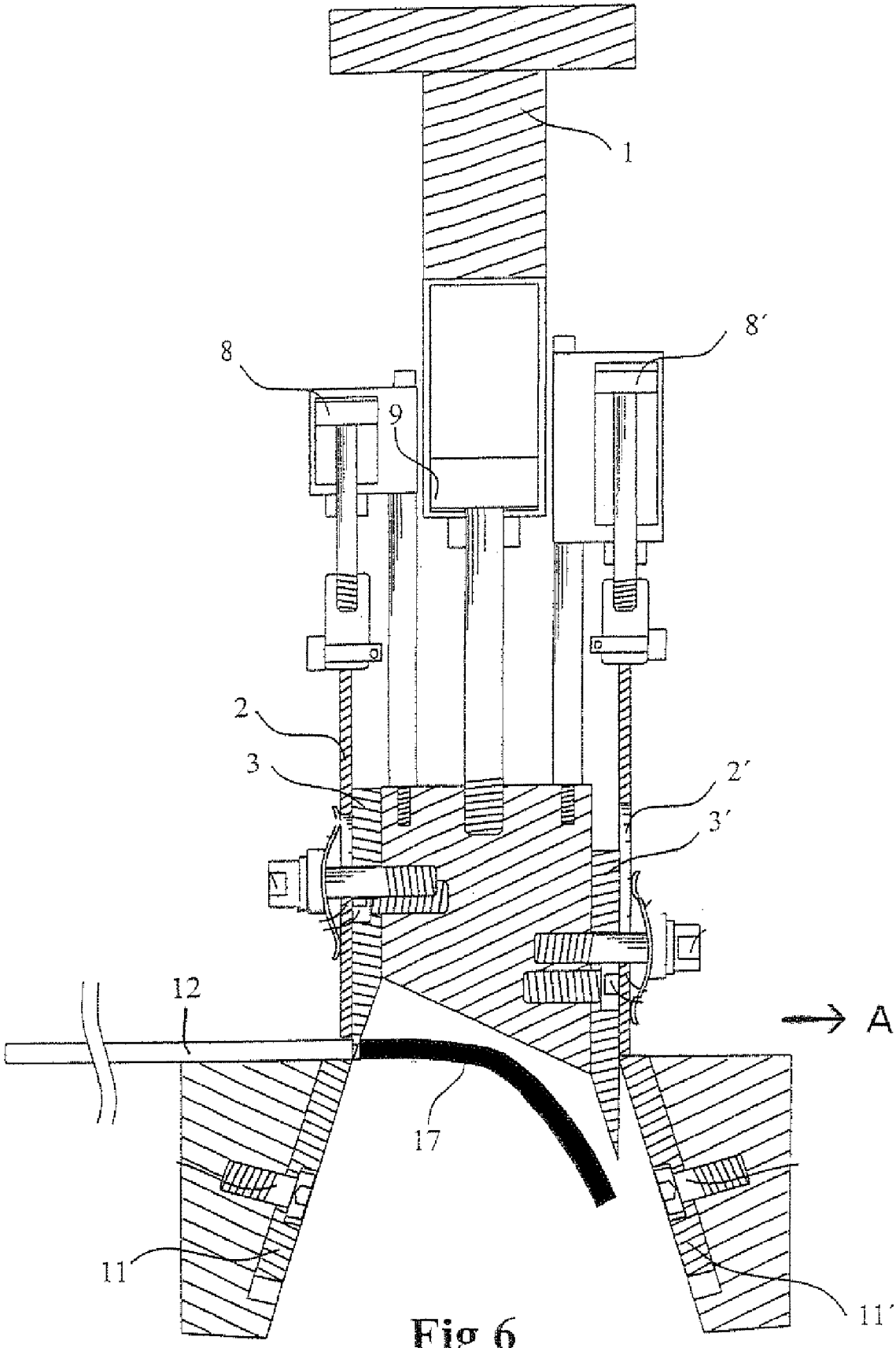
FIG. 6 illustrates the veneer cutter, when cutting a defective portion of a veneer sheet.

FIG. 6 shows a cutting situation illustrating one operational feature of the invention. The defective portion 17 appeared in the veneer 12, being e.g. a defective point in the central area of the veneer, has been cut off by the second blade 3' from the veneer moved forwards in the direction A. The veneer has been fed on, for a width required by the width of the defective portion 17, so that the rear edge of the defective portion can be brought under the first blade 3. In this situation, before the first blade 3 performs the cutting, the second blade 3' is below the edge of its respective counter blade 11' preventing the wide defective portion from moving to the delivery path of the sound veneer, in the direction A. Instead, the defective portion 17 is forced to the space B between the counter blades 11 and 11', and is discharged from the cutter among the scrap slices after the cutting performed by the first blade.

Figure 2:
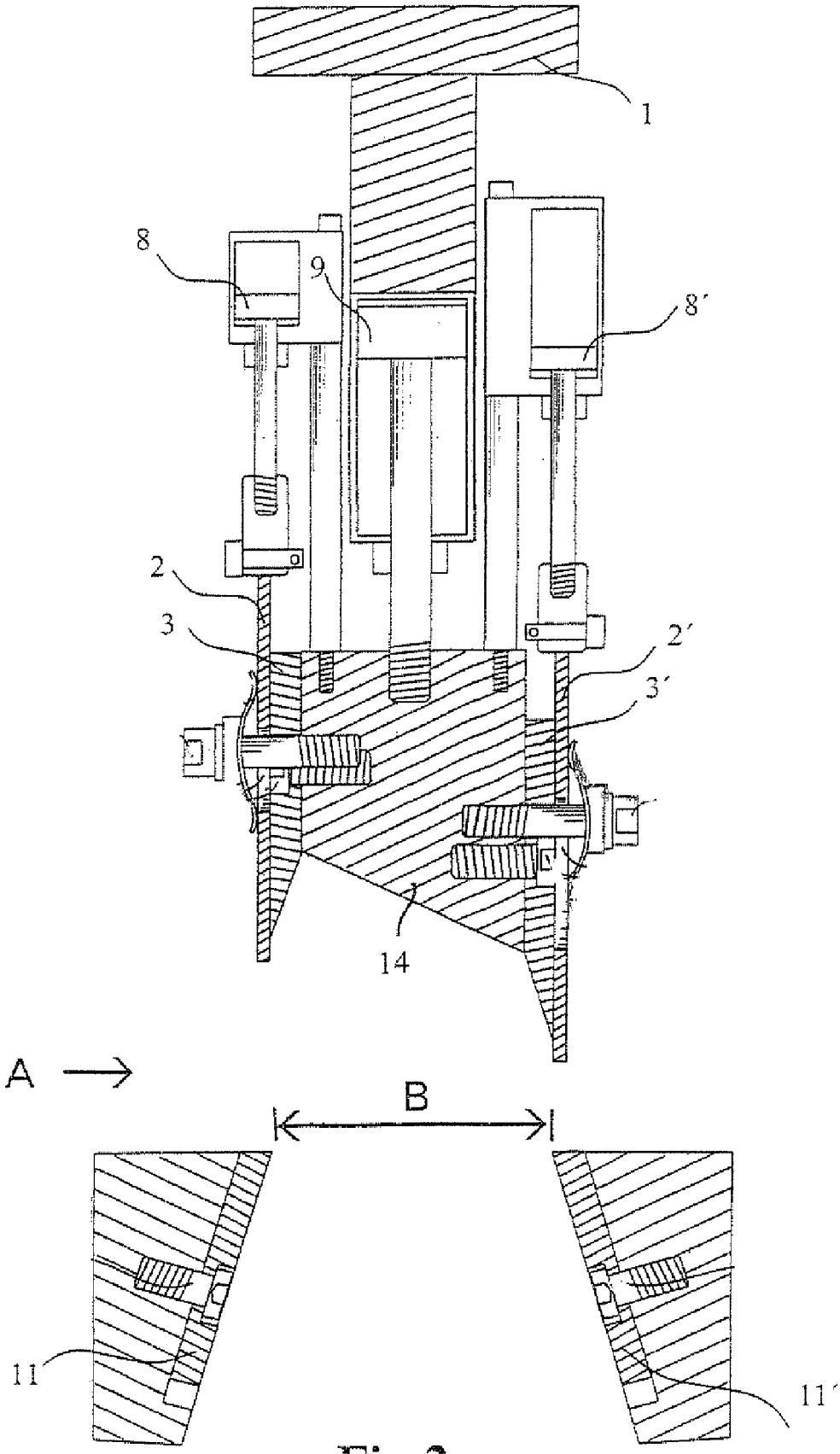
FIG. 2 illustrates one structural embodiment of a veneer cutter in one operational situation.

For disclosing an additional structural feature of the invention, reference is still made to the apparatus illustrated in FIG. 2. Pressing means 2 and 2' are mounted on the front rake face of the both cutting blades 3 and 3', respectively. These pressing means have limited movable in the direction of the cutting movement on the surface of the blades 3 and 3'. The pressing means 2 and 2' have an actuator 8 and 8', respectively, for providing a motion of the pressing means on the surface of the blades in the cutting direction with a predetermined force. The meaning of this predetermined force is to push the pressing means 2, 2' below the cutting edge of the respective blade, when the blades are in their inoperative position, above the respective counter blade.

The force pressing the pressing means must, however, be smaller than the force for pushing the blade beam 14 towards the counter blades 11 and 11' for performing the cutting. Thereby the pressing means yields to the cutting movement, when the pressing means has set against the counter blade or against the veneer resting thereon, and the pressing means slide on the surface of the blade to the opposite direction of the cutting movement. The pressing force must, however, be so strong, that the veneer between the pressing means 2 or 2' and the counter blade 11 or 11', respectively, can be straightened, whereby the precise cutting result can be guaranteed. Waving or bending of the veneer can thereby not affect the exactness of the cutting.

The invention claimed is:

1. A cutter for veneer fed in an advancing direction along a plane through the cutter, the cutter comprising:

in a first position in the advancing direction, a first cutting blade, in a following position in the advancing direction, a second cutting blade, and means for setting the first and second cutting blades to a common reciprocating movement essentially perpendicularly to the veneer for a cutting stroke, the first and second cutting blades having a one-sided beveled cutting edge leaving an essentially planar front rake in the respective cutting blade, a stationary counter blade on said plane for each of the first and second cutting blades in shearing contact with the cutting edge and the front rake of the respective cutting blade, the first cutting blade and the second cutting blade leaving a mutual distance in the advancing direction, wherein the first and the second cutting blades are arranged with front rake faces facing away from each other, and the first blade is arranged to reach a higher elevation from the veneer to be cut than the second cutting blade.

2. A cutter in accordance with claim 1, wherein between the counter blades there is a free space for removing scrap veneer pieces.

3. A cutter in accordance with claim 1, wherein the first and second cutting blades have on the front rake a pressing means movable on the front rake of the blade, and the cutter includes actuators for pushing the pressing means towards the respective counter blade, but allowing the cutting stroke.

4. A cutter in accordance with claim 2, wherein the first and second cutting blades have on the front rake a pressing means movable on the front rake of the blade, and the cutter includes actuators for pushing the pressing means towards the respective counter blade, but allowing the cutting stroke.

* * * * *